US008280782B1

(12) United States Patent
Talreja et al.

(10) Patent No.: US 8,280,782 B1
(45) Date of Patent: Oct. 2, 2012

(54) SYSTEM AND METHOD FOR MANAGING A LISTING OF OFFERS BETWEEN BUYERS AND SELLERS

(75) Inventors: Kamlesh T. Talreja, Issaquah, WA (US); Aditya Vikram Naredi, Seattle, WA (US); Timothy R. Kohn, Seattle, WA (US)

(73) Assignee: Amazon Technologies, Inc., Reno, NV (US)

( * ) Notice: Subject to any disclaimer, the term of this patent is extended or adjusted under 35 U.S.C. 154(b) by 1775 days.

(21) Appl. No.: 11/444,290

(22) Filed: May 31, 2006

(51) Int. Cl.
*G06Q 30/00* (2006.01)

(52) U.S. Cl. ..... 705/27.1; 705/26.4; 705/37

(58) Field of Classification Search ..... 705/26, 705/27, 37

See application file for complete search history.

(56) References Cited

U.S. PATENT DOCUMENTS 6,986,100 B1 * 1/2006 Roper et al. ..... 715/206
7,127,416 B1 * 10/2006 Tenorio ..... 705/26.62
7,330,826 B1 * 2/2008 Porat et al. ..... 705/26
7,437,317 B1 * 10/2008 Xia et al. ..... 705/26.1
2001/0034694 A1 * 10/2001 Elias ..... 705/37
2005/0065909 A1 * 3/2005 Musgrove et al. ..... 707/2
2005/0210043 A1 * 9/2005 Manasse ..... 707/100
2007/0100867 A1 * 5/2007 Celik et al. ..... 707/102
2007/0266001 A1 * 11/2007 Williams et al. ..... 707/2

OTHER PUBLICATIONS

Ostrom, Mary Anne; "Upstart portal features text-only advertising," Knight Ridder Tribune News Service, Oct. 31, 2002; Proquest #229429911, 3pgs.*

* cited by examiner

*Primary Examiner* — Robert M. Pond
(74) *Attorney, Agent, or Firm* — Thomas, Kayden, Horstemeyer & Risley, LLP.

(57) ABSTRACT

A computer-implemented system and method for generating and display a listing of offers of items to be sold on a third party marketplace. The system includes a processing unit and a storage device coupled to the processing unit. The processing unit has stored information for configuring the processing unit to receive a plurality of offers wherein each offer is associated with an item to be offered for sale, item information, and a seller identification. The processing unit is further configured to receive a search criterion, sort the plurality of offers based on the seller identification to generate one or more seller-specific offer listings, sort each of the seller-specific offer listings based on the search criterion, and generate a listing of offers by iteratively selecting an offer from each of the seller-specific search listings.

45 Claims, 9 Drawing Sheets

SYSTEM AND METHOD FOR MANAGING A LISTING OF OFFERS BETWEEN BUYERS AND SELLERS

BACKGROUND

Individuals often have items which they no longer want. The items include new items and used items which are in good enough condition that they do not need to be thrown away. Other individuals may be motivated to purchase such items because they are in good condition or because they can be purchased at a price which may be substantially less than that which would be paid for the same item purchased from a storefront or online retailer.

With the advent of network systems, such as the Internet, various forums have been developed that facilitate exchanges between buyers and sellers of miscellaneous new and second-hand items. For example, on-line third-party marketplace sites have been developed in which a plurality of sellers may make items available in an on-line sales format to buyers, and buyers are allowed to place bids on the items being sold.

With the on-line third party marketplace site, third party sellers are presented with an opportunity to submit offers for items that they wish to offer for sale. Each seller may further select a price at which they want to offer for sale. Each offer may further be associated with a plurality of sales conditions and item conditions that describe both the item and the type of transaction offered by the seller.

Buyers desiring to make a purchase may be presented with a search interface when they first come to the third-party sales site. The buyer searches for the item they wish to purchase and is presented with a plurality of offers from the third-party sellers that have submitted offers for that particular item. The offers may differ according to the prices that are offered by the seller as well as the various conditions that were selected by the seller. The buyer may select a sort criterion, such as a price, to sort the offers such that the "best" offers, according to the search criteria, are presented in a first listing of five offers on a first page, while less conforming offers are present in second, third, etc. listings on subsequent pages.

Buyer are often more likely to purchase an item from among the offers listed on earlier pages of listings than from among the offers listed on later pages of listings. Accordingly, some sellers may try to occupy as much space as possible on the first page of listings creating multiple offers for an item that are configured a variety of different ways. A seller may submit a first offer for the item having a low price, a second offer having a slightly higher price, a third offer having the same low price but a slightly different condition or sub-condition, etc., even where the seller is only selling a single item. Such practices detract from the buying experience of the buyer because it is more difficult for the buyer to find different competing offers from different sellers.

An ongoing need exists for systems and methods that facilitate management of a listing of offers to promote displaying items from multiple different third party sellers. It should be noted that, while certain advantages and features are described, the teachings herein may be used to implement systems and methods that do not have any of the advantages and features, but rather which have other advantages and features.

SUMMARY

One embodiment relates to a computer-implemented system and method for generating and displaying a listing of offers of items to be sold on a third party marketplace. The offers are generated by third party sellers offering items for sale in the marketplace. The listing of offers is configured to minimize the number of offers that are displayed to a buyer in any particular display that are associated with a single seller. The system and method may also be used to improve the buying experience for the buyer by including item conditions, item sub-conditions, or other information in each offer. The offer listing may further be configured to display a seller offer summary with each offer to indicate other offers that have been made by the same seller.

DETAILED DESCRIPTION OF EXEMPLARY EMBODIMENTS

Figure 1:
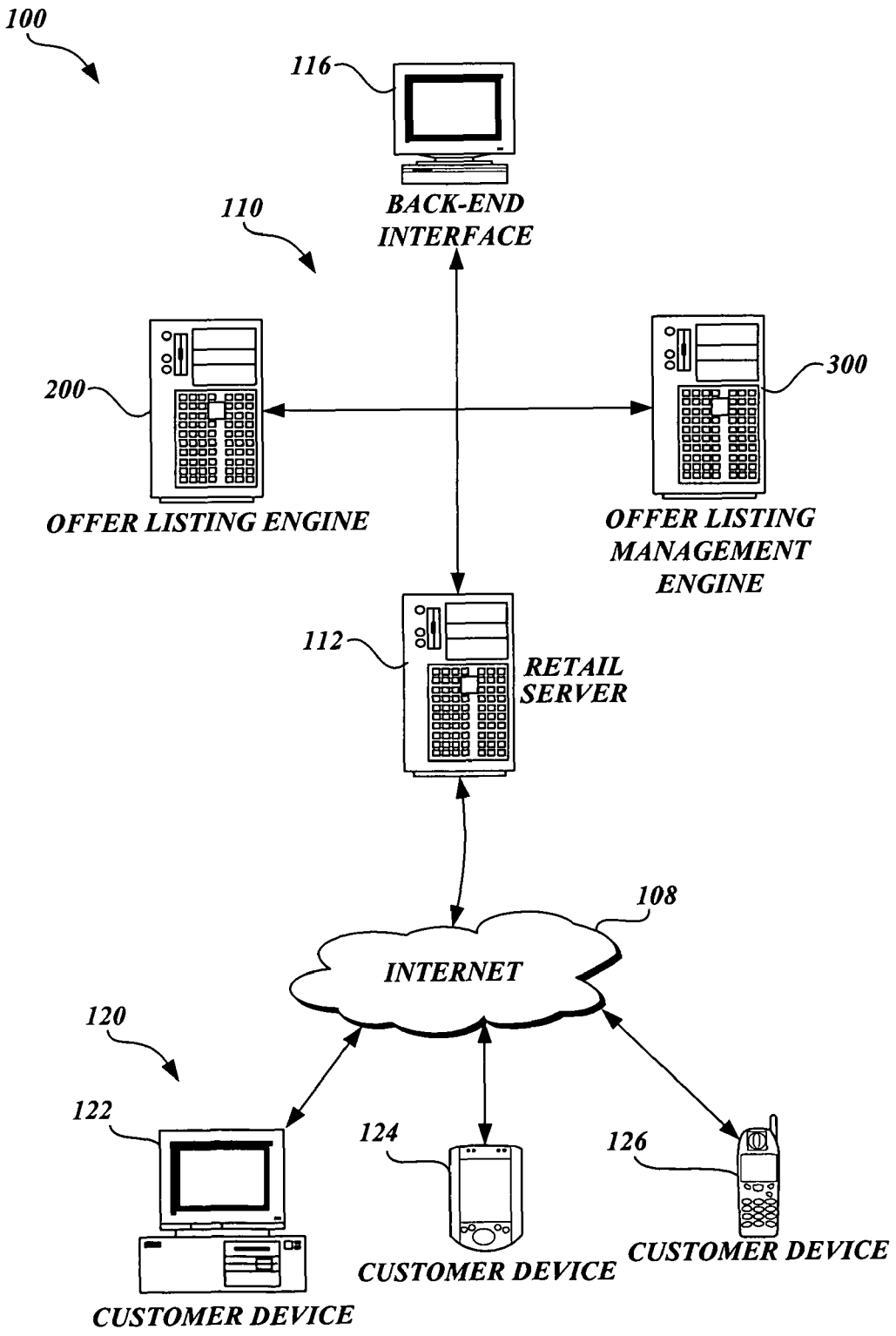
FIG. 1 is a block diagram of a third party marketplace system having a system for managing a listing of offers from a plurality of third party sellers, according to an exemplary embodiment.

Referring now to FIG. 1, a system 100 for implementing a third party marketplace including a system for managing a listing of offers submitted by a plurality of third party sellers to sell one or more items to a buyer is shown, according to an exemplary embodiment. System 100 includes an electronic third party marketplace system 110 and a plurality of computer systems 120 used by buyers and third party sellers. The third party marketplace system 110 may be implemented on one or more host computers and may be accessible to the computer systems 120 by way of a network, such as the Internet 108. Although system 100 is shown as including specific systems arranged according to a specific configuration, it should be understood that system 100 may include more, fewer, and/or a different configuration of systems to perform the functions described herein.

The third party marketplace system 110 includes a retail server 112, an offer listing engine 200, a back end interface 116, and an offer listing management engine 300. Engines 200 and 300 and interface 116 in third party marketplace system 110 may be implemented using separate computing systems (e.g., separate servers) as shown or may be implemented as processes on a single computing system. Further, each engine or interface may alternatively be implemented using multiple, distributed systems.

Retail server 112 is a computing system configured to provide a front-end interface to buyers and sellers desiring to perform transactions using the third party marketplace implemented by system 100. According to an exemplary embodiment, retail server 112 is configured to implement a plurality of web-base interfaces configured to allow buyers and sellers to set up and manage accounts, offer items for sale, provide information related to their offer of an item for sale, browse offers for items being offered for sale, purchase items being offered for sale, etc. Retail server 112 may also be configured to implement supportive functionality related to these transactions such as security functions, financial transaction functions, user identification functions, etc.

Retail server 112 may further be configured to provide an offer listing web page. The offer listing web page may include a plurality of web pages displaying offers for an item that has been offered for sale by third party sellers using system 100. The offer listing web page may display a first number of offers, such as five, on a first web page, a second number of offers on a second web page, etc. until all of the offers have been displayed. Alternatively, the offer listing web page may be configured such that the offer listing is provided on a single page and the buyer is presented with a scrolling navigation tool to facilitate navigation.

Offer listing engine 200 is a computing system configured to receive, store, and provide a listing of offers to sell items that have been submitted by a third party seller using a computing system 120. Each offer within the listing may include a wide variety of information related to the item and the sale of the item such as an item description, an item price, an item condition, shipping information, seller information, etc.

Offer listing engine 200 may further be configured to implement one or more functions related to the offer listing, such as a search function callable by retail server 112 based on input received through a user interface implemented by retail server 112. For example, a buyer using one of computer systems 120 may retrieve a search interface from retail server 112 for display on computing system 120. Alternatively, the user may alternatively be a third party computing system and the search terms may be provided by the third party computing system. The user may provide a search term in an input field of the user interface. The search term may be a general item type search term, such as "laptop computer," a specific search term, such that the name of a specific laptop computer, or any other desirable term. Retail server 112 may be configured to communicate this search term to offer listing engine 200. Offer listing engine 200 may implement a search function to search through the offer listing database to generate an offer listing containing all of the items in the offer database that correlate to the submitted search term. Where a generic term is entered, engine 200 may present a listing of items, wherein selection of an item initiates the display of offers for that item or may present a listing of offers, wherein the offers are for differing items. Accordingly, offer listing engine 200 may be configured to generate a complete listing of offers for laptop computers that are currently being offered for sale by third party sellers in third party marketplace system 110.

Back end interface 116 is a computing system configured to allow an implementer of system 100 to perform maintenance and implementation functions on system 110. Maintenance and implementation functions may be implemented using computer code configured to affect the operation of system 110. Exemplary functions may include performing database maintenance, implementing changes to the interfaces of server 112, implementing financial functions, etc.

Offer listing management engine 300 is a computer system configured to generate a seller identification sorted listing of offers based on the offer listing generated by offer listing engine 200. Engine 300 may be configured to generate the seller identification sorted listing of offers to optimize the number of offers from different sellers that are displayed to a buyer using system 100, as described in further detail below.

Computing systems 120 may include a desktop or laptop computing system 122, a handheld computing system 124, and a cellular computing device 126. Computing systems 120 are configured to enable buyers an sellers to connect to system 110 through the Internet 108 to sell or purchase items in the third party marketplace. In exemplary embodiments, the computing systems 120 may comprise personal computers, portable handheld devices (e.g., cellular telephones, PDA devices, portable e-mail devices), and other types of devices enabling users to view, edit, or otherwise access the information contained in the third party marketplace system 110. Some embodiments may include other systems in addition to or in place of the computing systems 120 to allow the user to interact with the third party marketplace system.

Figure 2:
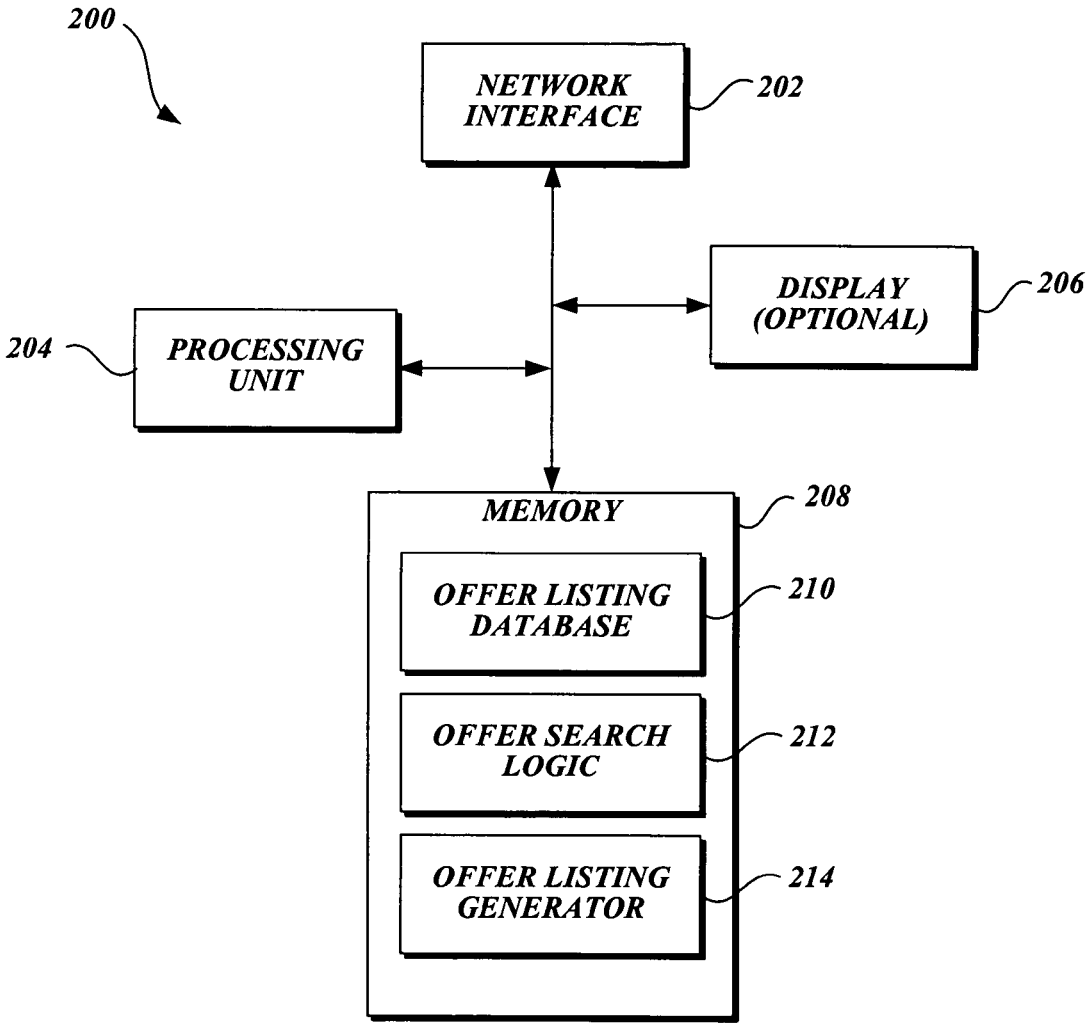
FIG. 2 is an offer listing server configured to receive a plurality of offers, store the offers, implement a searching function, and generate an offer listing to be displayed to at least one buyer utilizing the third party marketplace of FIG. 1, according to an exemplary embodiment.

Referring now to FIG. 2, an offer listing engine 200 configured to receive a plurality of offers, store the offers, implement a searching function, and generate an offer listing to be displayed to a buyer using the third party marketplace is shown, according to an exemplary embodiment. Engine 200 includes a network interface 202, a processing unit 204, a display 206, and computer memory 208. Computer memory 208 includes an offer listing database 210, offer search functionality 212, and an offer listing generator 214. System 200 and computer memory 208 may alternatively be implemented to include more, fewer, and/or a different configuration of systems and devices to implement the function described herein.

Network interface 202 may be any type of network interface configured to allow engine 200 to send and receive information from other servers and systems as needed to implement the offer listing functions described herein. Exemplary network types may include an intranet, the internet, etc. Exemplary interfaces may include a wireless interface, a Bluetooth interface, an Ethernet interface, etc. Processing unit 202 may include any type of computer processor configured to execute one or more instructions to generate data. Display 206 may be any type of display configured to display or otherwise communicate information to a user of system 200.

Computer memory 208 may be any type of computer memory configured to store and allow retrieval of information. Exemplary memory types may include, but are not limited to, flash memory, ROM memory, RAM memory, hard disk drives, CD-ROMS, floppy disks, etc.

Offer listing database 210 may be any type of computer database configured to receive the offers submitted by third party sellers desiring to sell one or more items in the third party marketplace 110. Each offer within the database 210 may consist of a database entry including a plurality of fields.

Exemplary fields may include an item title, an item description, an item price, an item condition, item seller comments, a seller identification for the seller making the offer, a seller rating, offer details, etc.

Offer listing database 210 may further be configured to operate in conjunction with processing unit 204 to implement one or more database functions. Exemplary database functions may include searching functions to search the database based on the offer listing fields, sorting functions, new offer listing functions, offer listing deletion functions, etc.

Offer search functionality 212 may be a plurality of functions configured to allow system 200 to provide searches of database 210 based on search terms entered by a user of computing devices 120. According to an exemplary embodiment, a user may utilize a computing device 120 to receive a third party marketplace web page hosted by retail server 112. The user may provide text in an input field of the web page to enter one or more search terms indicative of an item desired by the user. For example, the user may enter "laptop" to indicate a desire to see all offers related to laptop computing devices. Retailer server 112 may be configured to communicate the search terms to offer listing engine 200 to initiate a search of all of the offers stored in database 210 that have an item title or item description related to laptop computers.

Alternatively, engine 200 may be configured to provide a listing of items based upon receipt of the search terms from a user. The listing of items may include all items for which there are offers stored in database 210. The items populating the listing may be particular items matching the search term, such as brands of laptops; may be particular items having offers matching a specific item condition, such as offers to sell gently used instances of a particular brand of laptop; etc. The display of the listing of items may further include a numerical representation of the number of offers for that particular item in database 210, such as "XYZ Laptop (3 offers)." Following display of the items, the user may select a particular item to initiate display of a listing of offers for that particular item.

Offer listing generator 214 may be configured to generate a listing of offers based on results provided by offer search logic 212. As described above, the user may select the search to be a search of available items and/or available offers. For example, search logic 212 may identify all offers matching the search terms received from the user. These matching offers may be used to generate an offer listing. The offer listing may be randomly ordered or may be sorted according to one or more of the offer listing fields. Offer listing generator 214 may be configured to generate the offer listing according to a default sorting field, such as price. The offer listing may be provided as a table, a linked list, a collection of pointers to the information within database 210, etc. The offer listing may be further configured as an independent data set that may be provided to one or more external systems, such as offer listing management engine 300 as described in further detail below, or to retail server 112 for display to a user of computing device 120 on one or more third party marketplace 110 web pages.

Figure 3:
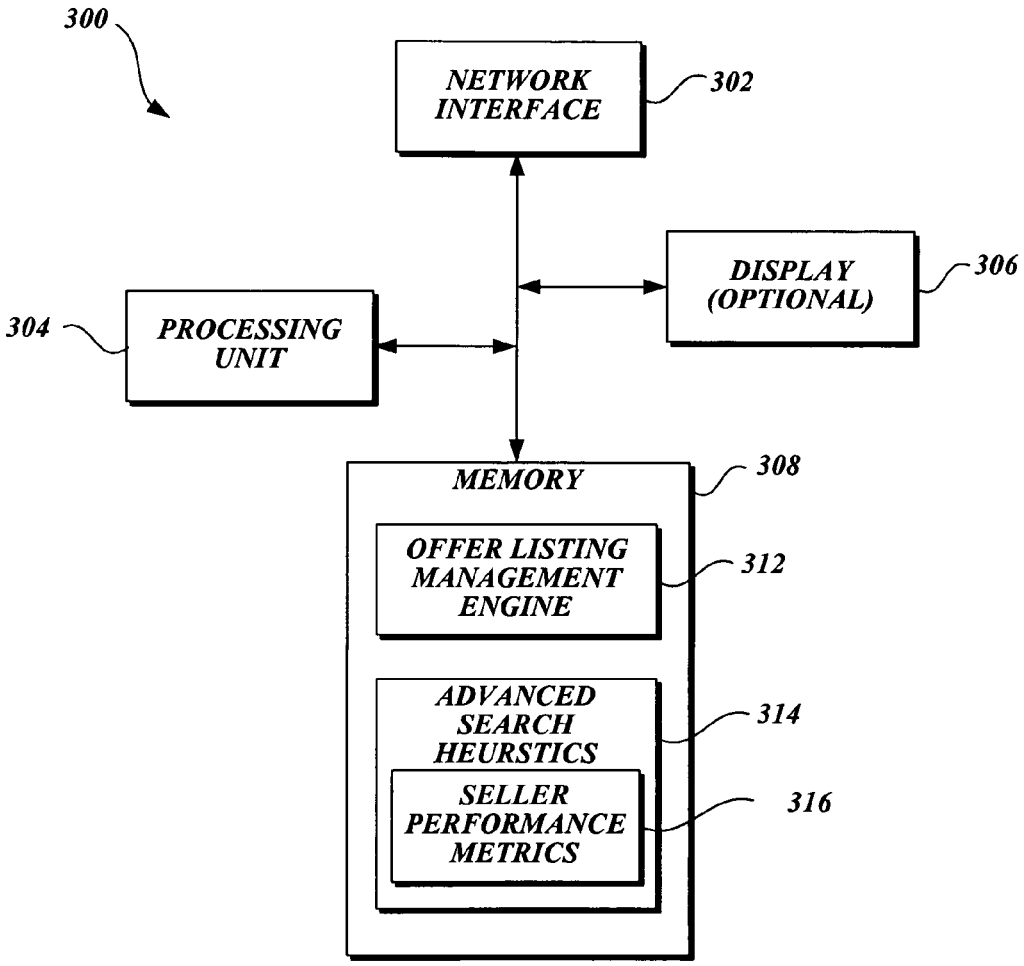
FIG. 3 is an offer listing management server configured to generate a seller identification sorted offer listing to optimize the number of offers from different sellers that are displayed to at least one buyer using the third party marketplace of FIG. 1, according to an exemplary embodiment.

Referring now to FIG. 3, an offer listing management engine 300 configured to manage an offer listing to optimize the number of offers from different sellers that are displayed to a buyer using the third party marketplace is shown, according to an exemplary embodiment. Engine 300 includes a network interface 302, a processing unit 304, a display 306, and computer memory 308, similar to network interface 202, processing unit 204, display 206, and computer memory 208 described above with reference to system 200 in FIG. 2. Computer memory 308 may be configured to store information and computer code for implementing offer listing management functions. Computer memory 308 includes an offer listing management engine 312 and an advanced sorting heuristic engine 314 including seller performance metrics 316.

Offer listing management engine 312 is configured to sort an offer listing such that when a portion of the offer listing is displayed on any particular offer listing page, there are a minimal number of redundant orders from a single third party seller. Accordingly, offer listing management engine 312 may be used to reduce the occurrence of third-party sellers monopolizing a first page of listings. The redundant offers will be displayed, but they may be re-positioned lower in a sorted offer listing. A method for generating the seller identification sorted offer listing is described in further detail below with reference to FIG. 5.

Sorting heuristic engine 314 is configured to manipulate the sorted offer listing based on one or more other parameters. For example, although offer listing management engine 312 may prevent third-party sellers from monopolizing web pages displaying a portion of the offer listing, engine 312 may unduly penalize sellers having truly non-redundant offers that are grouped together in the offer listing. Similarly, engine 312 may unduly reward some third-party sellers that are deservedly positioned lower in the offer listing based on high prices or a low seller performance rating. Accordingly, sorting heuristic engine 314 may be used to implement one or more advanced sorting rules or heuristics to adjust the sorted offer listing based on one or more external considerations, such as the degree of similarity between the offers in the listing.

Sorting heuristic engine 314 may be implemented as computer code configured to implement one or more business rules. Business rules may be automatically implemented during the generation of the seller identification sorted offer listing, or may be applied based on a detected anomaly in a generated seller identification sorted offer listing. For example, where the generated seller identification sorted offer listing includes a seller having a very low seller performance rating in a first tier of offers, the generated seller identification sorted offer listing may be modified to remove the offer from the first tier and increase the likelihood that the buyer will not have an unfavorable experience in the third party marketplace.

Seller performance metrics 316 may be a database of information associated with each of the sellers having items offered for sale in the third party marketplace system 110. The information may be historical or contemporary information representative of the performance of that particular seller within the third party marketplace system 100. Historical information may include the number of items sold in the third party marketplace, the number of complaints received about the seller, the number of returns of items sold by the seller, seller ratings from buyers that have made a purchase from the seller, etc. Contemporary information may include the seller's credit rating, the number of items currently offered for sale by the seller, etc. Seller performance metrics 316 may be based on a single factor or may be a generated value based on a composition of several factors.

Figure 4A:
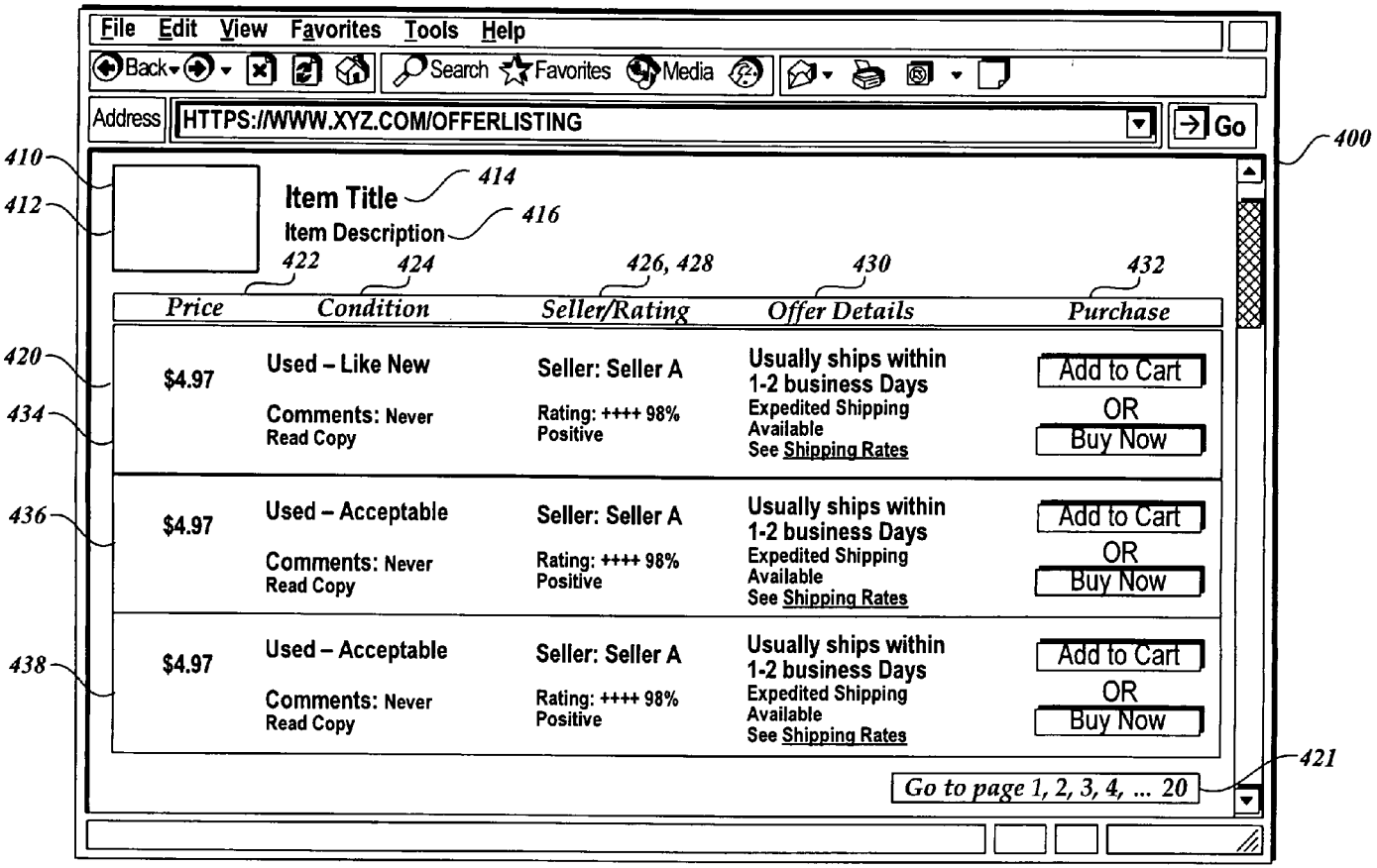
FIG. 4A is an exemplary interactive screen displayed to a user showing a portion of an unsorted offer listing including items for sale in the third party marketplace of FIG. 1, according to an exemplary embodiment.

FIG. 4A illustrates an exemplary interactive screen 400 displayed to a user showing a portion of an unsorted offer listing including items for sale in the third party marketplace, according to an exemplary embodiment. Interactive screen 400 may be implemented as a web page on retail server 112 that is displayed to a buyer using computing devices 120. Interactive screen 400 includes an item description display 410 and an offer listing display 420.

Screen 400 is configured to display a subset of an offer listing prior to application of an offer listing seller identification sorting function implemented by offer listing management engine 300 as described in further detail below with reference to FIG. 5. As can be seen in FIG. 4A, a single user, "Seller A," has submitted a plurality of offers to third party marketplace 110 that all have a similar price and has effectively monopolized the offer listing display 420 of interactive screen 400.

Item description display 410 may be an item detail display for a selected item. According to an exemplary embodiment, display 410 may be configured to allow the buyer to access additional details/information about the particular item for which offers have been submitted by clicking on the display. Display 410 contains information relating to the item for sale including an item picture 412, an item title 414, and an item description 416.

Item picture 412 may include one or more images, a "slide show" in which a set of images are displayed, a video clip of the item, or other such representation. Item photographs may also be included within each offer displayed in offer listing display 420. Seller-specific item pictures may be particularly useful where a user is selling a used or collectible item to allow a buyer to ascertain the condition of the item for that particular offer. If the seller has provided any such images of the item, the image may displayed in display 420. According to an exemplary embodiment, item picture 412 may be a generic picture of the item being offered for sale although it may not be a picture of a specific one of the items being offered for sale in display 420.

Item title 414 and item description 416 may be a title and description of the types of item for which offers are being displayed in offer listing display 420. According to an exemplary embodiment, item title 414 may be the search term that is used to generate the offer listing being displayed in part in display 420. Item description 416 may be a generic description related to the item for which offers are listed in the offer listing being displayed in part in display 420.

Offer listing display 420 may be configured to display all or a subset of the offers in the offer listing. For example, if an offer listing includes thirty-four offers, display 420 may be configured to display the first five offers on a first page, the second five offers on a second page, the third five offers on a third page, etc. Where display 420 is configured to display a subset of the offers in the offer listing, display 420 may further be configured to allow the user to browse forward or backward through that offer listing using an offer listing navigation tool 421.

For each offer displayed in display 420, various information may be included, such as, an offer price 422, an item condition 424, a seller identification 426, a seller rating 428, offer details 430, and a purchase function 432. The offer details may be either provided by the seller, such as the price 422 and item condition 424, or may be generated or provided by system 110, such as the seller identification 426 and seller rating 428.

Item condition 424 may be a condition selection chosen by the seller from a defined set of conditions, such as new, used, collectible, and refurbished. Item condition 424 may further be configured to allow the user to provide one or more item condition comments. Each item condition may further be associated with a plurality of sub-conditions that may be selected by the seller. For example, for offers to sell items having a used item condition, the item condition may further include an item sub-condition selection such as like new, good, and acceptable.

Seller identification 426 and seller rating 428 may be maintained and provided by system 100. Seller rating 428 may be an aggregate of the ratings supplied by other users of the system for this particular seller, along with the number of reviews upon which the rating is based. In some embodiments, each buyer may be able to choose to view additional details related to the seller, such as the seller's number of returns, other items the seller currently has available for purchase, comments related to the seller from other users who have had dealings with the seller in the past, the seller's contact information, and so on.

Offer details 430 may include any additional information that the seller wishes to communicate to a potential buyer regarding the offer. For example, offer details 430 may include shipping information, a return policy, item availability, restrictions, etc.

Purchase option 432 allows the buyer to make a selection to accept an offer and initiate a complete transaction with the seller. In an exemplary embodiment, the buyer may pay cash to complete the transaction. In another exemplary embodiment, the system 110 may allow the buyer to purchase an item from the seller by submitting a payment directly to the seller via an on-line transaction (e.g., a credit card or other form of electronic payment). Alternatively, payment may be submitted to a third-party intermediary. Such an embodiment also allows the buyer to inspect the item upon receipt and may provide a method for allowing the buyer to refuse the item for some reason and receive a refund of the electronic payment. If both sides agree to complete the transaction, then each party may transmit a respective electronic message (e.g., by pressing a button on a display) to the third-party intermediary to cause the third-party intermediary to release the payment to the seller and make the transaction final. Electronic confirmation may also be received from the third-party intermediary (e.g., again by pressing a button on a display).

As shown in FIG. 4A, display 420 is displaying all or a portion of an unsorted listing of offers. Because the listing of offers is unsorted, the listing displayed by system 100 shows an example of a single seller monopolizing display 420. Display 420 shows an example of multiple offers from a single seller that are genuinely different. Specifically, first offer 434 and second offer 436 appear to be genuinely different offers as shown by the different conditions listed in offers 434 and 436. Display 420 also shows and example of multiple offers from a single seller that appear to be the same offer. Specifically, second offer 436 and third offer 438 include the same price, condition, and description. In the example shown in display 420, the buyer is not presented with multiple non-similar offers from multiple different sellers. Although multiple offers are shown, the offers are either the same offer from the same seller or are similar offers from the same seller.

Figure 4B:
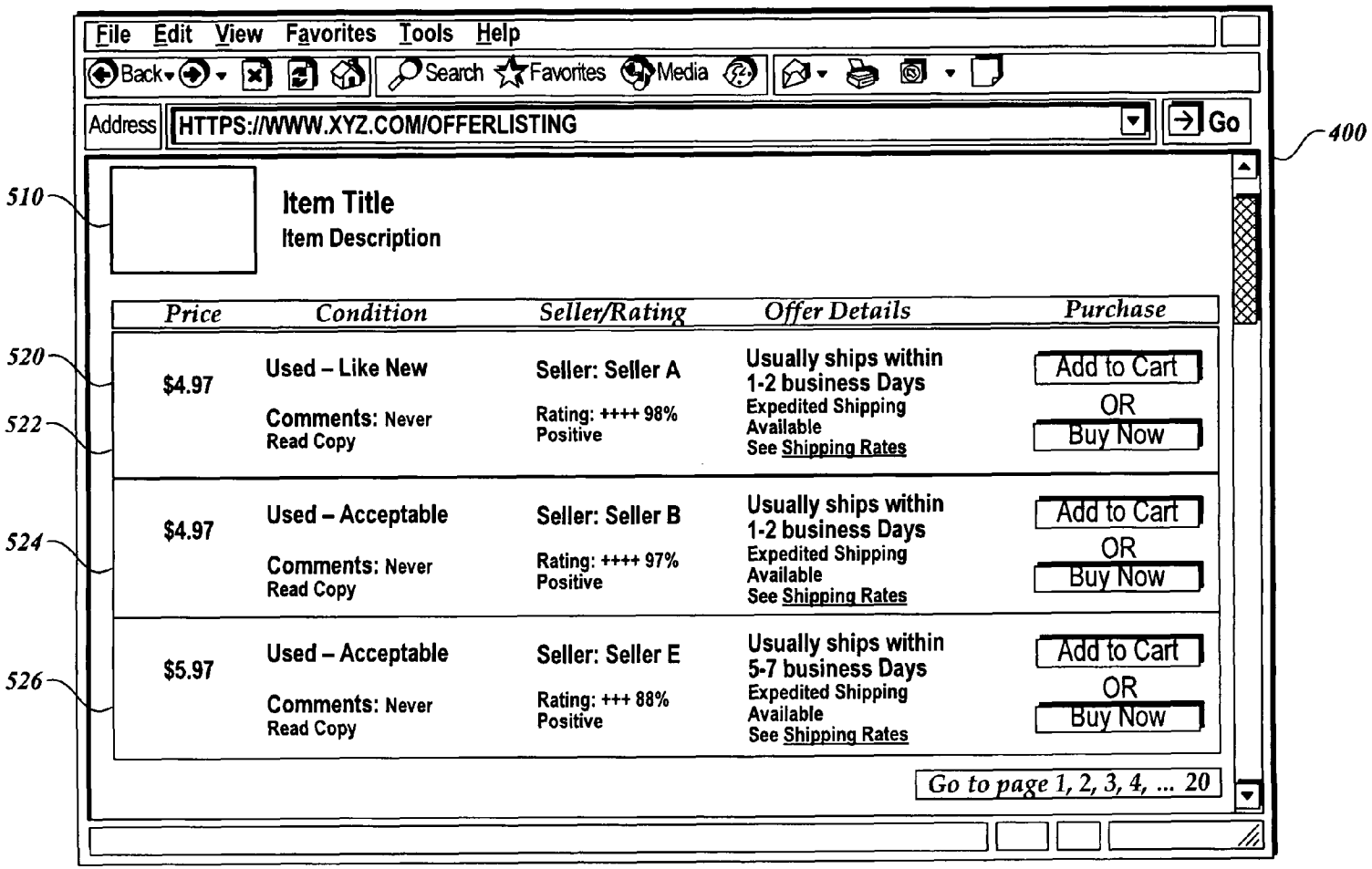
FIG. 4B is an exemplary interactive screen displayed to a user and showing a portion of a seller identification sorted offer listing including offers for an item for sale in the third party marketplace of FIG. 1, according to an exemplary embodiment.

FIG. 4B illustrates exemplary interactive screen 500 displayed to a user showing a portion of a seller identification sorted offer listing including items for sale in the third party marketplace, according to an exemplary embodiment. Interactive screen 500 includes an item description display 510 and an offer listing display 520, similar to displays 410 and 420, described above with reference to FIG. 4A. Interactive screen 500 is configured to display the same offer listing as shown in interactive screen 400. However, the portion of the offer listing shown in display 520 is a sorted offer listing sorted using a seller identification sorting method described in further detail below with reference to FIG. 5.

The portion of the sorted offer listing shown in display 520 includes a first offer 522, a second offer 524, and a third offer 526. As shown, the offers shown in display 520 are from third party sellers having different seller identifications, specifically "Seller A," "Seller B," and "Seller E."

As shown in display 520, second offer 524 appears to be similar to first offer 522 and would be equally advantageous to a buyer. However, since interactive screen 400 is configured to display an unsorted offer listing as shown in FIG. 4A, Seller B is excluded from display 420 because of the monopolization of display 420 by Seller A. Displaying a user-identification sorted offer listing as shown in display 520 increases to number of different offers that are displayed to a buyer.

However, display 420 also displayed a second offer from seller A, offer 438, that appears to be more advantageous (i.e., has a lower price) than third offer 526 shown is display 520. Accordingly, providing a seller identification sorted offer listing, although increasing the number of offers from different sellers, may decrease the overall advantageousness of the offers that are displayed.

Figure 4C:
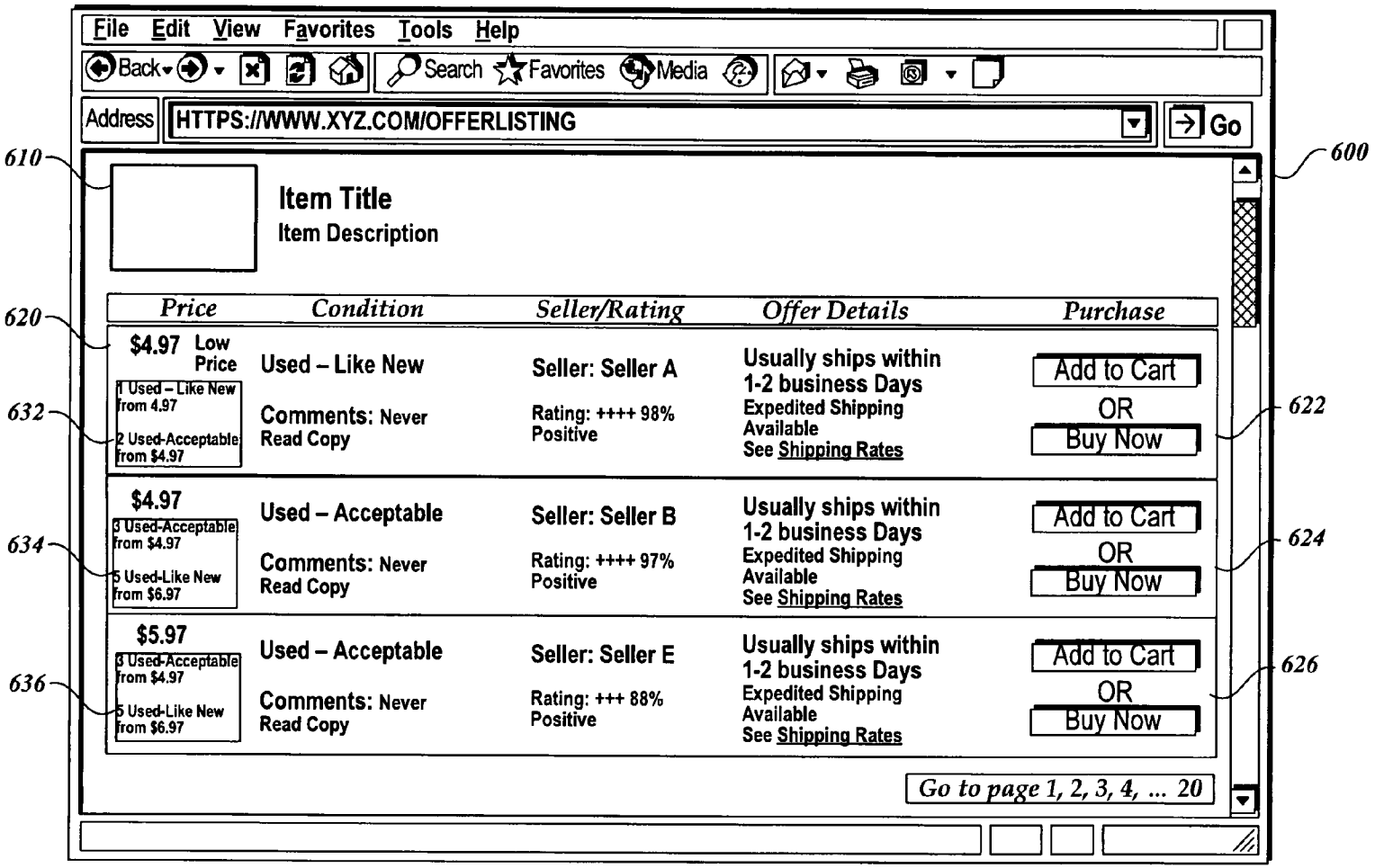
FIG. 4C is an exemplary interactive screen displayed to a user showing a portion of a sorted offer listing including offers for an item for sale in the third party marketplace of FIG. 1 and also displaying a seller offer summary, according to an exemplary embodiment.

FIG. 4C illustrates exemplary interactive screen 600 displayed to a user showing a portion of a sorted offer listing including offers for one or more items for sale in the third party marketplace and also displaying a seller offer summary, according to an exemplary embodiment. Interactive screen 600 includes an item description display 610 and an offer listing display 620, similar to displays 410 and 420, described above with reference to FIG. 4A. Interactive screen 600 is configured to display the same portion of the sorted offer listing shown in interactive screen 500 and further display a seller offer summary for each offer.

Display 620 of interactive screen 600 is configured to include a seller offer summary associated with each offer displayed. A first offer 622, associated with Seller A, includes a first seller offer summary 632 configured to display a summary of all of the other offers within the offer listing that are also associated with Seller A. Similarly, second offer 624 and third offer 626 are associated with second seller offer summary 634 and third seller offer summary 636, respectively. A seller offer summary displayed in association with every offer from a seller allows the buyer to recognize the existence of multiple, possibly more advantageous, offers from the seller even while the seller identification sorting method reduces the number of offers from a single seller that are shown in display 620. Accordingly, display 620 is configured to maximize the diversity of offers that are displayed to the user. Maximizing the diversity of the offers can include maximizing the number of offers from different sellers, maximizing the number of offers that have a low degree of similarity with other offers in the display, maximizing the number of offers having different conditions and/or sub-conditions, etc.

Figure 4D:
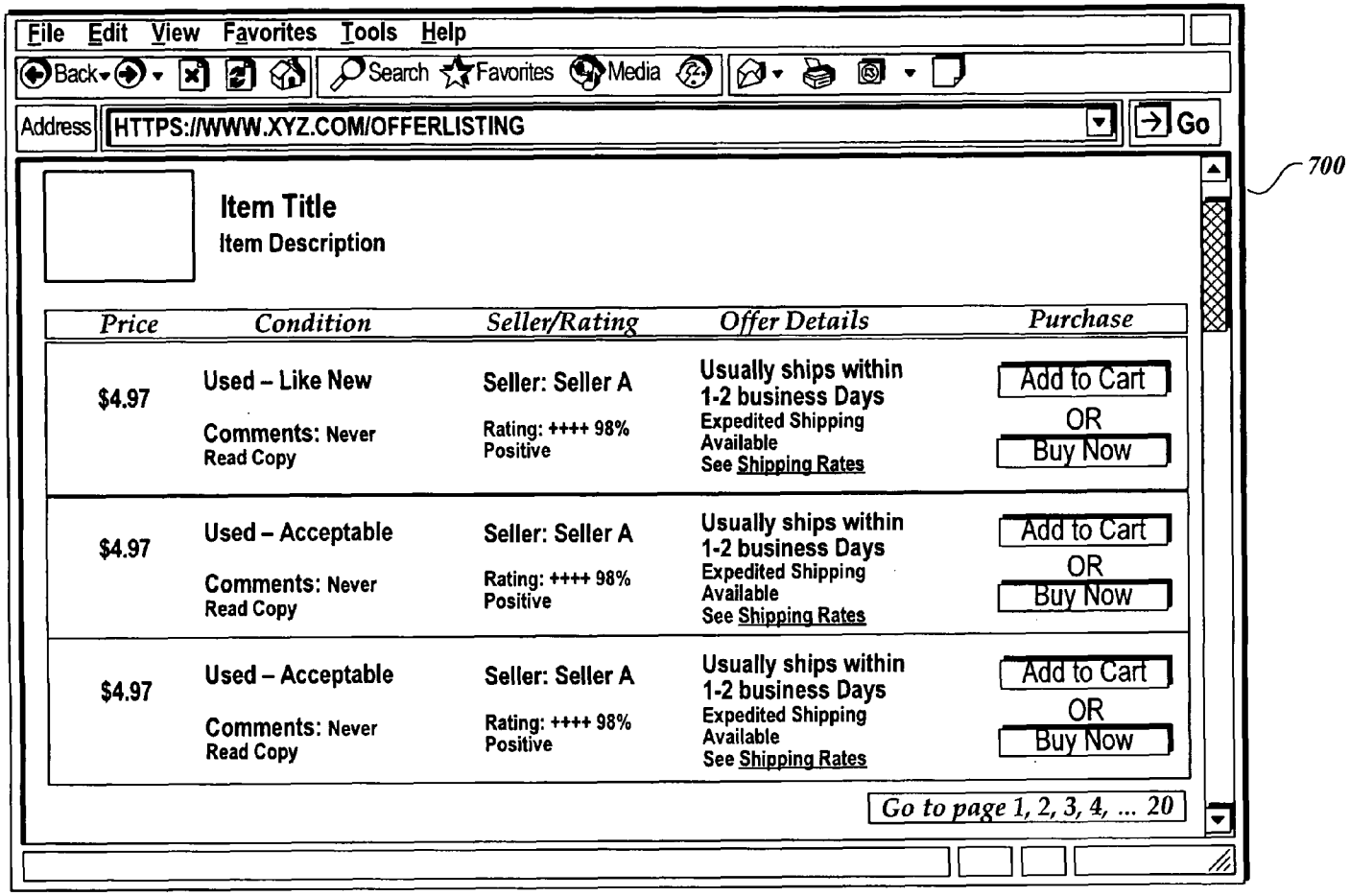
FIG. 4D is an interactive screen configured to display only offers within an offer listing that are associated with a particular seller, according to an exemplary embodiment.

Seller offer summaries 632-636 may be implemented as hyperlinks. Accordingly, when a buyer clicks on first seller offer summary 632, a seller specific interactive screen 700, illustrated in FIG. 4D according to an exemplary embodiment, is displayed which includes only those offers within the offer listing that are associated with the particular seller. Accordingly, interactive screen 700 allows a buyer to view all items the seller has currently being offered for sale.

Figure 5:
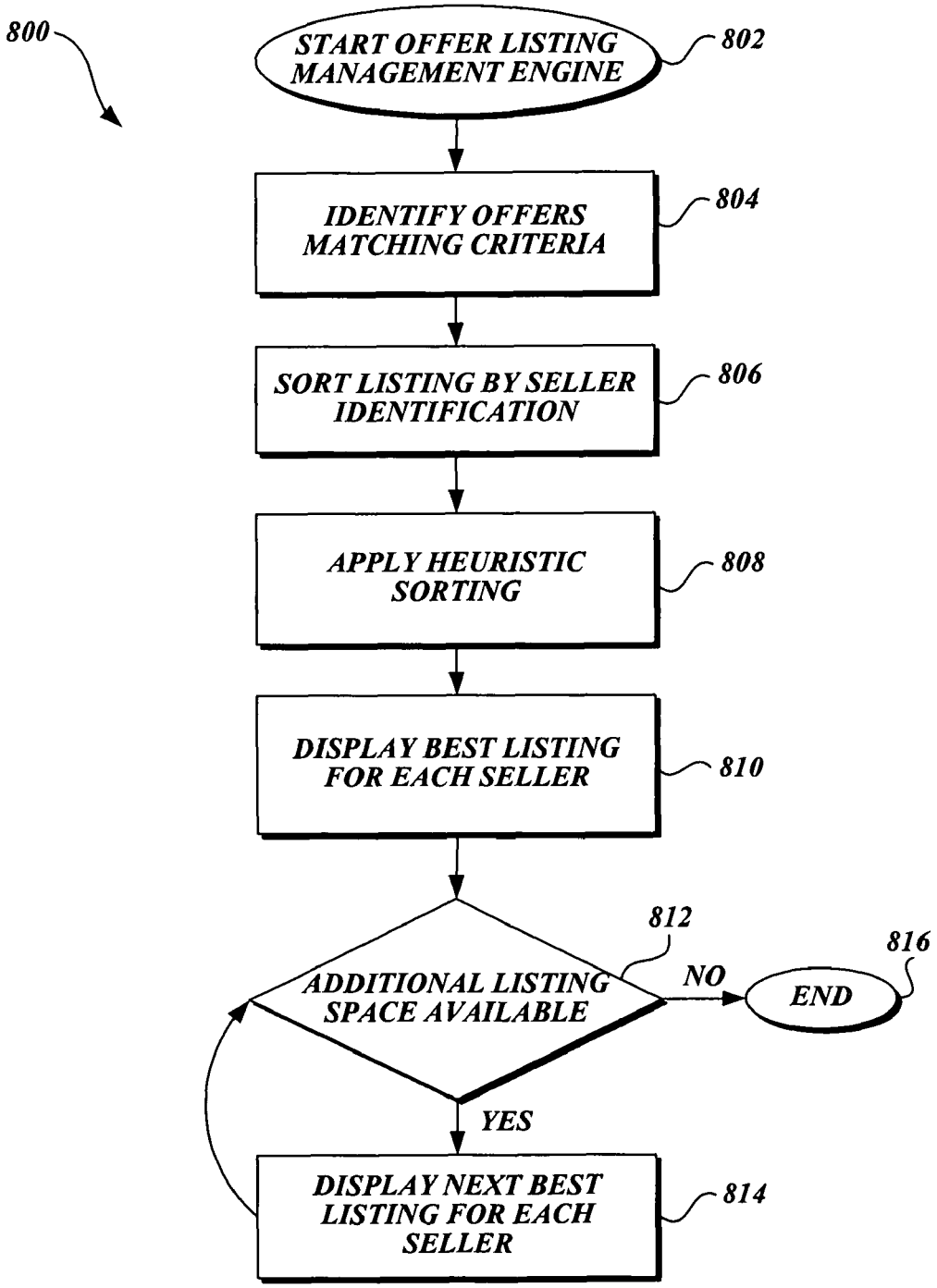
FIG. 5 is a flow chart showing an exemplary process for sorting an offer listing based on a seller identification to generate a sorted offer listing, according to an exemplary embodiment.

FIG. 5 is a flow chart showing an exemplary process 800 for sorting an offer listing based on a seller identification to generate a sorted offer listing, according to an exemplary embodiment. The process 800 may, for example, be used as part of an offer listing search procedure to enable the buyer to view a listing of offers or items associated with offers matching a buyer-defined search criteria where the offers viewed by the buyer include offers from a maximum number of different sellers.

The process 800 begins at step 802 where the offer listing including all of the offers matching a buyer-defined search criteria is received. As stated above, the offer listing may be offers to sell a single type of item or multiple types of items. According to an exemplary embodiment, the offer listing may be received by offer listing management engine 300 from offer listing engine 200. The received offer listing may have been generated by offer listing engine 200 based on search terms entered by a buyer using a computing device 120 to access a third party marketplace web page hosted by retail server 112.

The process 800 continues to step 804 to sort the received offer listing according to a default or buyer-defined sort criteria. Engine 300 may include a default sort criteria based on observed buyer sort preferences. For example, if it is observed that most buyers tend to sort offer listing by price or even always tend to select the lowest price offer, the default sort criteria may be price. Alternatively, the sort criteria may be defined by the buyer according to their individual preferences. For example, one type of buyer may value security and be willing to pay a possible higher price to select an offer from a seller having the highest seller performance rating.

Sorting the offer listing may further include performing a second round of sorting within the boundaries of the first sort criteria according to a second sort criteria. For example, where the offer listing as been sorted based on price, and five offers all have the same price, these five offers may then be sorted according to a second sort criteria, such as seller performance rating.

Although described herein as a sorting step 804 performed by offer listing management engine 300, the offer listing received in step 802 may have already been sorted by offer listing engine 200 prior to transmission and step 804 can be skipped.

Upon receipt of the listing of offers, the listing may be sorted based on seller identification in a step 806. If the offer listing has been previously sorted as described above with reference to step 804, sorting the listing by seller identification may be performed such that the "best offer", as defined by the search or other criteria, for each seller will automatically be displayed higher in the search listing. For example, step 806 may be performed by scanning the received offer listing to identify the total number of sellers that have made offers in the offer listing to compose a seller listing. Then, in a first round, the best offer from the sorted offer listing may be selected as the best offer in the seller identification sorted offer listing and that seller is marked in the seller listing as having contributed in the present round of selections. Thereafter, no more offers may be selected from the sorted offer listing for the marked seller until an offer has been selected from each of the other sellers in the seller listing having remaining offers in the sorted offer listing. Selection of the next offer includes selecting the best offer in the sorted offer listing that is associated with a seller that has not been marked as having contributed in the present round.

The process described with reference to step 806 may be iteratively performed until all of the offers in the sorted offer listing have been included in the seller identification sorted listing of offers. Although a specific implementation and sorting algorithm has been described above with reference to steps 804 and 806, it should be appreciated by one of skill in the art that a number of different sorting methods having varying trade-offs may alternatively be implemented.

After a seller identification sorted offer listing has been generated, offer listing management engine 300 may be configured to apply one or more advanced heuristic sorting techniques to modify the order of the sorted list in a step 808. Applying one or more advanced heuristic sorting techniques may include utilizing one or more rules to modify the order based on external factors.

Advance heuristic techniques may be utilized to achieve any of a variety of performance and/or buyer protection goals. One example is where a specific seller is a premium seller within the third-party marketplace characterized by a large volume of sales, a high seller performance rating, consistently providing truly non-similar offers, etc., an advanced heuristic technique may be implemented to allow the user to have additional offers higher in the seller identification sorted offer listing. For example, the sorting technique 806 may be implemented such that the premium seller is allowed two offer selection within any particular round, the seller identification sorted listing may be modified such that any offer by the premium seller gets bumped upwards in the listing, etc. Applying advanced heuristics may be used to both reward a seller and to increase the likelihood that buyers will be presented with offers from sellers that have a history of providing satisfying transactions.

Process 800 proceeds in a step 810 at which the seller identification sorted offer listing is displayed to a buyer in an offer listing display of an interactive screen. Generally, the seller identification sorted offer listing will include more offers that can reasonably be displayed to a buyer on a first page of display on the interactive screen. Accordingly, displaying an offer includes presenting a best listing from each seller and then determining whether there is additional space available in a step 812. If there is additional space, the next best listing for each seller may be display in a step 814 until no more space is available in which case the process ends in a step 816.

Figure 6:
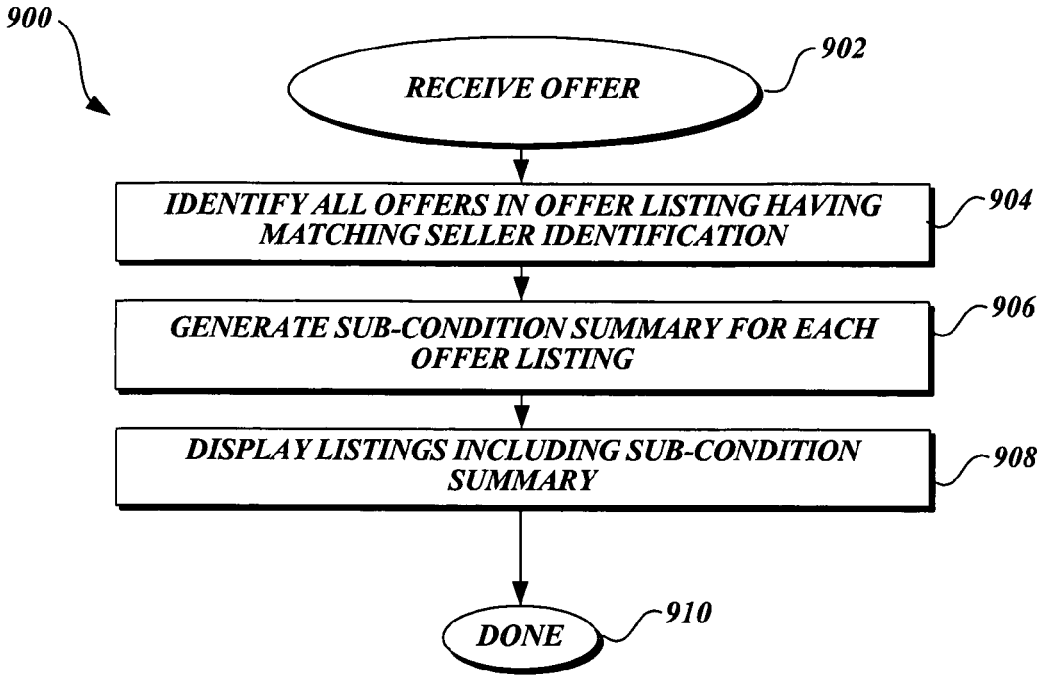
FIG. 6 a flow chart showing a process used to generate and display to a buyer an offer listing summary to be associated with each offer that is displayed to the buyer, according to an exemplary embodiment.

FIG. 6 is a flow chart showing a process 900 used to generate and display to the buyer an offer listing summary to be associated with each offer that is displayed to a buyer, according to an exemplary embodiment. The process 900 begins at step 902 where an offer to be displayed is received. The offer to be displayed may be received during an initial search of the offer database by engine 200, during generation of the seller identification sorted offer listing by engine 300, during an actual display of the offer by retail engine 112, or at any other time prior to presentation of the offer to a buyer.

Upon receipt of the offer in step 902, the seller identification for the offer may be retrieved and used to identify all of the other offers within the offer listing associated with the same seller identification in a step 904. The identification of all other offers may be broadly or narrowly defined dependent on user preference, the size of the offer listing, or any other factor. For example, identification of all other offers may include all offers by that seller, all offers having a matching item title, all items having a matching item title and item condition, etc.

The identified offers may be used to generate a seller offer summary in a step 906 that can be presented to the buyer in a step 908. The offer summary may be configured to provide as much information as possible about the seller's other offers while maintaining the readability of the information displayed to the buyer. Accordingly, the buyer offer summary may include a description of the number of other offers and the lowest price and item condition associated with those offers. The seller offer summary may be displayed to the buyer in display 620 when the associated offer is presented to the buyer. The seller offer summary may further by presented to the buyer as a hyperlink configured to allow the buyer to select the summary and be present with a detail listing of the seller's other offers. After the offer summary is displayed, process 900 ends in a step 910.

Although the systems and methods described herein are described with reference to offers of items for sale within a third party marketplace, it should be understood that the systems and methods may equally be application to any other type of search result where each search results is associated with a search result owner identification. For example, the above systems and method may be used to generate listings of search results that are configured to minimize the number of search results that are displayed to a searcher that are associated with a single web site. The generated listing of search results may be customized to present improved search results by applying one or more search heuristics. Exemplary heuristics may include sorting and/or including search results based on timing information, relevance information, etc. Accordingly, a listing of search results may be processed by offer listing management engine 300 to generate a search result owner identification sorted listing of search results.

Those skilled in the art will also appreciate that the sample screens discussed above may be structured in different manners, with information added or removed, with information displayed on more screens or fewer screens, and with the interaction between various screens implemented in different manners. The data structures supporting the screens may also be structured in a different manner and contain more or less information than depicted.

It should be noted that although flow charts may be provided herein to show a specific order of method steps, it is understood that the order of these steps may differ from what is depicted. Also, two or more steps may be performed concurrently or with partial concurrence. Such variation will depend on the software and hardware systems chosen and on designer choice. It is understood that all such variations are within the scope of the invention. Likewise, software and web implementations of the present invention could be accomplished with standard programming techniques with rule based logic and other logic to accomplish the various database searching steps, correlation steps, comparison steps, and decision steps. It should also be noted that the word "component" as used herein and in the claims is intended to encompass implementations using one or more lines of software code, and/or hardware implementations, and/or equipment for receiving manual inputs. It is to be understood that any method steps as recited herein (e.g., in the claims) may be performed by a configuration utility (e.g., Java™-based) executed by a computing device based on input by a user. Of course, according to various alternative embodiments, any suitable configuration utility, application, system, computing device, etc. may be used to execute, implement and/or perform method steps as recited in this disclosure (including the claims).

Although functions have been described herein as being performed by particular systems or sub-systems, it should be understood that any described function may alternatively be performed by any of system or sub-system of system 100. Further, functions described herein as being performed as being performed by system 100 may alternatively be performed by any external system coupled to system 100.

The invention is described above with reference to drawings. These drawings illustrate certain details of specific embodiments that implement the systems and methods and programs of the present invention. However, describing the invention with drawings should not be construed as imposing on the invention any limitations associated with features shown in the drawings. The present invention contemplates methods, systems, and program products on any machine-readable media for accomplishing its operations. The embodiments of the present invention may be implemented using an existing computer processor, or by a special purpose computer processor incorporated for this or another purpose or by a hardwired system.

As noted above, embodiments within the scope of the present invention include program products comprising machine-readable media for carrying or having machine-executable instructions or data structures stored thereon. Such machine-readable media can be any available media which can be accessed by a general purpose or special purpose computer or other machine with a processor. By way of example, such machine-readable media can comprise RAM, ROM, PROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions comprise, for example, instructions and data which cause a general purpose computer, special purpose computer, or special purpose processing machine to perform a certain function or group of functions.

Embodiments of the invention have been described in the general context of method steps which may be implemented in one embodiment by a program product including machine-executable instructions, such as program code, for example, in the form of program modules executed by machines in networked environments. Generally, program modules include routines, programs, objects, components, data structures, etc. that perform particular tasks or implement particular abstract data types. Machine-executable instructions, associated data structures, and program modules represent examples of program code for executing steps of the methods disclosed herein. The particular sequence of such executable instructions or associated data structures represent examples of corresponding acts for implementing the functions described in such steps.

Embodiments of the present invention may be practiced in a networked environment using logical connections to one or more remote computers having processors. Logical connections may include a local area network (LAN) and a wide area network (WAN) that are presented here by way of example and not limitation. Such networking environments are commonplace in office-wide or enterprise-wide computer networks, intranets and the Internet and may use a wide variety of different communication protocols. Those skilled in the art will appreciate that such network computing environments will typically encompass many types of computer system configurations, including personal computers, hand-held devices, multi-processor systems, microprocessor-based or programmable consumer electronics, network PCs, minicomputers, mainframe computers, and the like. Embodiments of the invention may also be practiced in distributed computing environments where tasks are performed by local and remote processing devices that are linked (either by hardwired links, wireless links, or by a combination of hardwired or wireless links) through a communications network. In a distributed computing environment, program modules may be located in both local and remote memory storage devices.

An exemplary system for implementing the overall system or portions of the invention might include a general purpose computing device in the form of a computer, including a processing unit, a system memory, and a system bus that couples various system components, including the system memory to the processing unit. The system memory may include read only memory (ROM) and random access memory (RAM). The computer may also include a magnetic hard disk drive for reading from and writing to a magnetic hard disk, a magnetic disk drive for reading from or writing to a removable magnetic disk, and an optical disk drive for reading from or writing to a removable optical disk such as a CD-ROM or other optical media. The drives and their associated machine-readable media provide nonvolatile storage of machine-executable instructions, data structures, program modules, and other data for the computer.

The foregoing description of embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principals of the invention and its practical application to enable one skilled in the art to utilize the invention in various embodiments and with various modifications as are suited to the particular use contemplated.

What is claimed is:

1. A computer-implemented data processing system for facilitating exchanges of items, comprising:

a processing unit; and a storage device coupled to the processing unit and having information stored therein for configuring the processing unit to:

receive a plurality of offers wherein each offer is associated with an item to be offered for sale in an electronic marketplace, offer information, and a seller identification;

receive a search criterion;

sort the plurality of offers based on the seller identification to generate one or more seller-specific offer listings, each seller identification having at least one seller heuristic associated therewith;

sort each of the seller-specific offer listings based on the search criterion;

generate a listing of offers by iteratively selecting an offer from each of the seller-specific search listings;

modify the order of the listing of offers according to the at least one seller heuristic; and transmit the listing of offers to a customer device.

2. The system of claim 1, wherein the item information for each offer includes one or more item conditions and wherein configuring the processing unit to sort each of the seller-specific offer listings based on one or more search criteria includes configuring the processing unit to sort the listings based on an item condition.

3. The system of claim 1, wherein the item condition includes at least one of new, used, collectible, or refurnished.

4. The system of claim 3, wherein each item condition further includes an item sub-condition, and wherein sorting each of the seller-specific offer listings based on one or more search criteria includes sorting based on an item condition and item sub-condition.

5. The system of claim 4, wherein the item sub-condition includes at least one of like new, good, or acceptable.

6. The system of claim 1, wherein the storage device further has information stored therein for applying the at least one seller heuristic to each of the seller-specific listings to identify a degree of similarity between each offer in the seller-specific listings.

7. The system of claim 6, wherein configuring the processing unit to generate the listing of offers by configuring the processing unit to:

select a second offer from a seller-specific offer listing based on application of the at least one seller heuristic; and compare the second offer to a third offer having a unique seller identification.

8. The system of claim 7, wherein the second offer is from the same seller specific offer listing as the first offer.

9. The system of claim 1, wherein the processing unit is further configured to display a seller offer summary for a seller associated with each offer including a summary of all of the offers associated with the seller in the offer listing.

10. The system of claim 9, wherein the seller offer summary is presented as a hyperlink configured to link to a display of all of the offers in the offer listing associated with the seller.

11. A method for generating a seller identification sorted listing of offers, comprising:

receiving, in at least one computing device, a plurality of offers wherein each offer is associated with an item to be offered for sale in an electronic marketplace, item information, and a seller identification, each seller identification being associated with at least one seller heuristic;

receiving a search criterion in the at least one computing device;

sorting, in the at least one computing device, the plurality of offers based on the seller identification to generate one or more seller-specific offer listings;

sorting, in the at least one computing device, each of the seller-specific offer listings based on the search criterion;

generating, in the at least one computing device, a seller identification sorted listing of offers by iteratively selecting an offer from each of the seller-specific search listing;

modifying, in the at least one computing device, the order of the seller identification sorted listing of offers according to the at least one seller heuristic; and transmitting the seller identification sorted listing of offers from the at least one computing device to a customer device.

12. The method of claim 11, wherein the item information for each offer includes one or more item conditions, and wherein sorting each of the seller-specific offer listings based on one or more search criteria includes sorting based on an item condition.

13. The method of claim 12, wherein the item condition includes at least one of new, used, collectible, or refurbished.

14. The method of claim 13, wherein each item condition further includes an item sub-condition, and wherein sorting each of the seller-specific offer listings based on one or more search criteria includes sorting based on an item condition and item sub-condition.

15. The method of claim 14, wherein the item sub-condition includes at least one of like new, good, or acceptable.

16. The method of claim 11, further including applying the at least one seller heuristic to each of the seller-specific listings to identify a degree of similarity between each offer in the seller-specific listings.

17. The method of claim 16, wherein generating the listing of offers includes selecting a second offer from a seller-specific offer listing based on application of the at least one seller heuristic and comparison of the second offer with a third offer having a unique seller identification.

18. The method of claim 11, further comprising displaying an offer summary for a seller associated with each offer including a summary of all of the offers associated with the seller in the offer listing.

19. The method of claim 18, wherein the offer summary is presented as a hyperlink configured to link to a display of all of the offers in the offer listing associated with the seller.

20. A method for generating a listing of offers to sell an item by third party sellers, comprising:

receiving, in at least one computing device, offers from a plurality of the third party sellers of items, wherein each offer includes a seller identification, an indication of one or more items desired to be sold, and an indication of one or more conditions associated with each item, and wherein at least one seller heuristic is associated with each seller identification;

receiving, in the at least one computing device, information including an indication of one or more items desired to be purchased and one or more sorting criteria to be used in sorting the offers;

generating, in the at least one computing device, a listing of offers, the listing of offers including offers from third party sellers offering to sell items desired to be purchased;

sorting, in the at least one computing device, the listing of offers based on the one or more sorting criteria;

selecting, in the at least one computing device, an offer associated with each seller having an offer in the sorted listing of offers in one or more iterative selection rounds until all of the offers have been selected to generate a seller identification sorted listing of offers;

modifying, in the at least one computing device, the order of the seller identification sorted listing of offers according to the at least one seller heuristic; and transmitting the seller identification sorted listing of offers from the at least one computing device to a customer device.

21. The method of claim 20, wherein the item information for each offer includes one or more item conditions, and wherein sorting the listing of offers based on one or more sorting criteria includes sorting based on an item condition.

22. The method of claim 21, wherein the item condition includes at least one of new, used, collectible, or refurbished.

23. The method of claim 22, wherein each item condition further includes an item sub-condition, and wherein sorting the listing of offers based on one or more sorting criterion includes sorting based on an item condition and item sub-condition.

24. The method of claim 23, wherein the item sub-condition includes at least one of like new, good, or acceptable.

25. The method of claim 24, further including applying the at least one seller heuristic to the seller identification sorted listing of offers to sort the listing of offers based on at least one of an item condition and an item sub-condition.

26. The method of claim 20, wherein generating a listing of offers includes:

generating a listing of items based on the indication of one or more items desired to be purchased, wherein each item in the listing of items is associated with one or more offers, receiving a selection of an item in the listing of items, and generating the listing of offers based on the selection of an item.

27. The method of claim 20, further including applying the at least one seller heuristic to the seller identification sorted listing of offers to identify a degree of similarity between each offer in the listing of offers.

28. The method of claim 27, wherein generating the listing of offers includes selecting a second offer from a seller-specific offer listing based on application of the at least one seller heuristic and comparison of the second offer with a third offer having a unique seller identification.

29. The method of claim 20, wherein the at least one seller heuristic identifies a premium seller.

30. The method of claim 20, further comprising displaying a seller offer summary for a seller associated with each offer including a summary of all of the offers associated with the seller in the listing of offers.

31. The method of claim 30, wherein the seller offer summary is presented as a hyperlink configured to link to a display of all of the offers in the listing of offers associated with the seller.

32. A method of presenting a listing of search results generated based on a search of a user-submissions wherein each submission is associated with a user identification, comprising:

receiving, in at least one computing device, a search criterion;

receiving, in the at least one computing device, a plurality of search results correlated to the search criterion, wherein each search result is associated with a search result owner identification, each user identification having at least one user heuristic associated therewith;

generating, in the at least one computing device, a listing of the received search results;

sorting, in the at least one computing device, the search results based on the search result owner identification to generate a plurality of search result owner specific listings of results;

sorting, in the at least one computing device, the search result owner specific listings of results based on the search criterion;

generating, in the at least one computing device, a sorted listing of search results by iteratively selecting a search result from each of the search result owner specific listings and placing the search result in the sorted listing of search results until all search results have been removed from the search result owner specific listings;

modifying, in the at least one computing device, the order of the sorted listing of search results according to the at least one user heuristic; and transmitting the sorted listing of search results from the at least one computing device to a customer device.

33. The method of claim 32, wherein generating the listing of the received search results includes applying the at least one user heuristic to the received search results to identify the relevance of the search results.

34. The method of claim 32, wherein generating the listing of the received search results includes applying the at least one user heuristic to the received search results to identify timing associated with the search results.

35. The method of claim 32, wherein selecting a search result from each of the search result owner specific listings includes removing the search result in order based on how well the search results match the search criteria.

36. The method of claim 32, wherein the search result includes an offer of an item for sale and the search result includes an item condition and an item sub-condition.

37. The method of claim 32, wherein the item condition includes at least one of new, used, collectible, or refurbished.

38. The method of claim 37, wherein each item condition further includes an item sub-condition, and wherein sorting each of the search result owner specific listings of results based on one or more search criterion includes sorting based on an item condition and item sub- condition selected by a buyer.

39. The method of claim 38, wherein the item sub-condition includes at least one of like new, good, or acceptable.

40. The method of claim 32, wherein generating the sorted listing of search results includes switching the order of two search results within the sorted listing of search results based on based on:

a determination of lack of similarity between one of the two search results and a third search result having the same search result owner identification.

41. The method of claim 32, wherein generating the sorted listing of search results includes switching the order of two search results within the sorted listing of search results based on based on:

a determination that the search result owner identification associated with the offer is a premium seller.

42. A system for presenting a listing of search results generated based on a search of a search results wherein each submission is associated with a search result owner identification, comprising:

a search engine configured to generate, in at least one computing device, a plurality of search results based on a search criterion entered by a user, each search result including an identification of the search result owner, each identification of the search result owner being associated with at least one owner heuristic;

a search result optimization engine configured to generate, in the at least one computing device, a sorted listing of search results, including:

sorting the search results based on the identification of the search result owner;

sort the search results based on the search criterion; and generate a sorted listing of search results by iteratively selecting a search result from each of the user-identification specific listings and placing the search result in the sorted listing of search results until all search results have been removed from the user-identification specific listings;

modify the order of the sorted listing of search results according to the at least one owner heuristic; and transmit the sorted listing of search results to a customer device.

43. A method for generating a web page to display a listing of items being offered for sale, comprising:

receiving, in at least one computing device, a plurality of offers from third party sellers, each offer including a seller identification of the seller making the offer, each seller identification having at least one seller heuristic associated therewith;

generating, in the at least one computing device, a listing of offers based on a search criterion;

sorting, in the at least one computing device, the listing of offers based on the seller identification to generate a seller-specific listing of offers; and generating, in the at least one computing device, a web page for displaying the seller-specific listing of offers, the web page including a subset of the seller-specific listing of offers wherein the subset is configured to minimize the number of offers in the subset having the same seller identification by iteratively selecting offers from the seller-specific listing of offers to be included in the subset of the seller-specific listing of offers, the subset of the seller-specific listing of offers being ordered according to the at least one seller heuristic.

44. A method for generating a web page to display a listing of items being offered for sale, comprising:

receiving, in at least one computing device, a plurality of offers from third party sellers, each offer including a seller identification of the seller making the offer, each seller identification having at least one seller heuristic associated therewith;

generating, in the at least one computing device, a listing of offers based on a search criterion;

sorting, in the at least one computing device, the listing of offers based on the seller identification to generate a seller-specific listing of offers; and generating, in the at least one computing device, a web page for displaying the seller-specific listing of offers, the web page including a subset of the seller-specific listing of offers wherein the subset is configured to maximize the diversity of offers based on the seller identification by iteratively selecting offers from the seller-specific listing of offers to be included in the subset of the seller-specific listing of offers, and wherein the subset of the seller-specific listing of offers is ordered according to the at least one seller heuristic.

45. A non-transitory computer-readable medium embodying a program executable in at least one computing device, comprising:

code that receives a plurality of offers wherein each offer is associated with an item to be offered for sale, item information, and a seller identification, wherein at least one seller heuristic is associated with each seller identification;

code that receives a search criterion;

code that sorts the plurality of offers based on the seller identification to generate one or more seller-specific offer listings;

code that sorts each of the seller-specific offer listings based on the search criterion; code that generates a seller identification sorted listing of offers by iteratively selecting an offer from each of the seller-specific search listings;

code that modifies the order of the seller identification sorted listing of offers according to the at least one seller heuristic; and code that facilitates transmitting the seller identification sorted listing of offers to a customer device.

* * * * *